US006848402B2

(12) United States Patent
Kreuter

(10) Patent No.: US 6,848,402 B2
(45) Date of Patent: Feb. 1, 2005

(54) METHODS AND APPARATUS FOR PROVIDING VARIABLE VALVE LIFT FOR CAMSHAFT-ACTUATED VALVES

(75) Inventor: Peter Kreuter, Aachen (DE)

(73) Assignee: Meta Motoren-und Energie-Technik GmbH (DE)

( * ) Notice: Subject to any disclaimer, the term of this patent is extended or adjusted under 35 U.S.C. 154(b) by 0 days.

(21) Appl. No.: 10/612,501

(22) Filed: Jul. 2, 2003

(65) Prior Publication Data

US 2004/0003789 A1 Jan. 8, 2004

(30) Foreign Application Priority Data

Jul. 4, 2002 (DE) ..... 102 30 108

(51) Int. Cl.[7] ..... F01L 1/34

(52) U.S. Cl. ..... 123/90.16; 123/90.2; 123/90.17; 123/90.15; 123/90.31

(58) Field of Search ..... 123/90.16, 90.15, 123/90.17, 90.2, 90.27, 90.31

(56) References Cited

U.S. PATENT DOCUMENTS 5,297,516 A * 3/1994 Hara ..... 123/90.16
5,655,488 A * 8/1997 Hampton et al. ..... 123/90.16
6,101,991 A 8/2000 Glover ..... 123/73 PP
6,591,798 B2 * 7/2003 Hendriksma et al. .... 123/90.16

FOREIGN PATENT DOCUMENTS

DE 31 19 133 12/1982
JP 2001207814 8/2001

* cited by examiner

*Primary Examiner*—Thomas Denion
*Assistant Examiner*—Kyle M. Riddle
(74) *Attorney, Agent, or Firm*—R. W. Becker & Associates; R W Becker

(57) ABSTRACT

Apparatus suitable for use in reciprocally opening and closing a camshaft-actuated valve may include a rotating camshaft (20) having first and second cams (16, 17, 18) respectively defining first and second amounts of valve opening distance. A cam follower (10, 11, 12) may be defined on a mounting pin (24) so as to operatively engage the first and second cams in an alternating manner. At a first rotational position of the cam follower relative to the camshaft, the cam follower operatively engages the first cam and generates the first amount of valve opening distance. At a second rotational position, the cam follower operatively engages the second cam and generates the second amount of valve opening distance. A valve lever (6) transmits the respective generated first and second amounts of valve opening distance to the valve. A locking device (50) releasably locks the mounting pin and cam follower in the respective first and second rotational positions.

25 Claims, 3 Drawing Sheets

METHODS AND APPARATUS FOR PROVIDING VARIABLE VALVE LIFT FOR CAMSHAFT-ACTUATED VALVES

CROSS-REFERENCE

Priority is claimed to German patent application no. 102 30 108.5, filed Jul. 4, 2002, the contents of which are hereby incorporated herein in their entirety.

TECHNICAL FIELD

The present teachings relate to apparatus for providing at least two different valve opening positions (valve opening distances) for valves actuated by a camshaft, which apparatus may be suitably used, e.g., in an internal combustion engine, as well as methods for making and using such apparatus.

DESCRIPTION OF THE RELATED ART

In some vehicle conditions, it is desirable to adjust the amount of valve opening distance (valve lift) during operation of an internal combustion engine. Therefore, known valve assemblies may include a full valve lift position and a partial valve lift position (intermediate valve lift position) and it is possible to switch back and forth between the full valve lift and partial valve lift positions in order to change the opening distance of the valve.

Thus, in the partial valve lift position, the valve is opened by a distance that is less than the full valve lift position. As a result, the amount of fuel air input into the cylinder can be directly controlled (throttled) by only partially opening or lifting the valve. Furthermore, when the valve is only partially lifted, the opening distance between the valve and the valve seat of the cylinder is reduced, as compared to fully opening or lifting the valve. Therefore, in the partially-lifted state, the reduced opening distance causes the air/fuel to enter the cylinder at a higher velocity (induction speed) than in the fully-lifted state. Consequently, the fuel and air can be thoroughly mixed, even when the vehicle is being operated in a low power output condition. Thus, such techniques are capable of improving vehicle fuel efficiency when the vehicle is operating in a low power output condition.

One known valve lift adjusting device is described by German Laid-open Patent Publication No. 31 19 133 A1, in which two control cams having different control curve configurations are associated with each valve. In order to transmit the cam control lift to the valve, a valve rocker lever is associated with each of the two control cams and the two valve rocker levers are mounted on a control shaft. An eccentric bearing portion is defined on the control shaft and is operatively coupled to one rocker lever. By rotating the control shaft, the rocker levers can alternately be brought into engagement with the associated cam control curve configuration in an appropriate relationship for the respective engine speed. However, this known valve lift adjusting device requires two valve rocker levers per valve, thereby providing a quite bulky arrangement that is not suitable for many known engine designs.

Japanese Laid-open Patent Publication No. 2001-207814 discloses another known valve lift adjusting device in which a plurality of cams, each providing a different amount of lift, is arranged in an axially mutually juxtaposed relationship along a camshaft. Cam follower members co-operate with the cams and are arranged on a second shaft. The camshaft is axially displaceable as a whole. Therefore, by axially displacing the entire camshaft, different cam follower members will operatively engage the cams. This design is also quite unsuitable for most engines due to necessity of axially moving the entire camshaft.

Accordingly, there is been a long-felt need in the vehicle field to develop a compact valve-adjusting device that is capable of providing at least one partial valve lift valve opening position and that does not require changes to the overall design of the engine for incorporation.

SUMMARY OF THE INVENTION

Accordingly, it is one object of the invention to provide improved methods and devices for variably adjusting the amount of valve lift (i.e., variable valve opening distances) during operation, e.g., of a vehicle engine. The present teachings provide examples of devices that have a relatively simple and reliable structure and these representative designs can be easily utilized within existing designs for internal combustion engine. However, a skilled person may of course utilize the present teachings in the construction of new engine designs.

Generally speaking, the present teachings are suitable for, but not limited to, designs utilizing a valve that is actuated or controlled by a camshaft via a valve lever. The valve is reciprocally movably mounted within the cylinder head for enabling fuel/air to be charged into a cylinder bore when the valve is moved to a valve open position. A play compensating device optionally may be utilized to support the present valve-lift adjusting devices with respect to a stationary or fixed element within the engine, such as the cylinder head. The play compensating device preferably provides a biasing force that maintains the camshaft, valve-lift adjusting device and the valve in operative engagement during operation of the engine.

The present valve-lift adjusting devices preferably may include a cam follower defining at least first and second cam follower members (e.g., cam rollers) that alternatively co-operate with (operatively engage) at least first and second cams (e.g., cam lobes) defined on the camshaft. The first cam follower member preferably provides a full valve lift function (full valve opening function) when the first cam follower member operatively engages the first cam defined on the camshaft. The second cam follower preferably provides a partial or reduced valve lift function (partial valve opening function) when the second cam follower operatively engages the second cam defined on the camshaft. Naturally, three or more cam follower members may be defined within the valve-lift adjusting device, with corresponding three or more cams defined on the camshaft, in order to provide a full valve-lift function and two or more partial valve-lift functions. The two or more partial valve-lift functions can, of course, impart different amounts of partial valve lift (i.e., two or more (different) partial or intermediate valve opening distances, in addition to the full lift) to the valve.

Various methods for partially and fully opening a camshaft-actuated valve are also taught herein.

The present teachings are applicable to all types of valve devices that are actuated or controlled by a camshaft, and are not limited to vehicle engines. Furthermore, when valve lift adjustment during operation is desired, the present teachings are quite advantageous, in particular for use with known engine designs. In the following representative examples, the present teachings are applied to camshaft-actuated valves utilized with an engine design comprising a piston that reciprocates inside a cylinder bore defined within the internal combustion engine for the purpose of combusting fuel and driving the vehicle.

Additional objects, features and advantages of the present teachings will be readily understood to a person of ordinary skill in the art after reading the following detailed description of examples and embodiments of the present teachings together with the claims and the accompanying drawings.

DETAILED DESCRIPTION OF THE INVENTION

Figure 1:
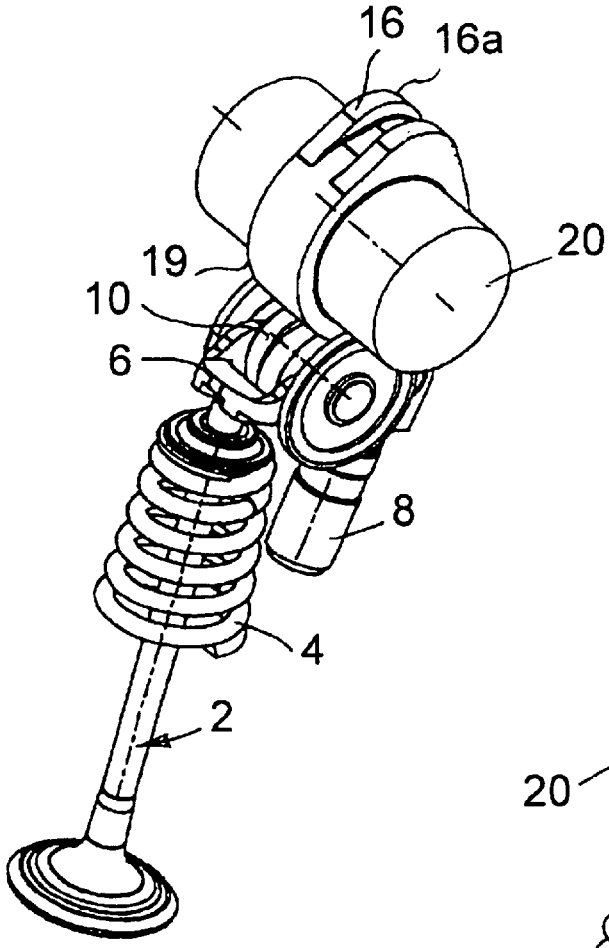
FIG. 1 shows a first perspective view of a first representative valve lift adjusting device according to the present teachings.

In one embodiment of the present teachings, apparatus suitable for use in reciprocally moving a valve are taught. For example, such apparatus preferably cause the valve to open and close in a reciprocal manner. Further, such apparatus may include a rotating camshaft comprising at least a first cam and a second can. When a cam follower operably engages the first cam of the rotating camshaft, preferably a first valve opening distance or range is generated by the operable engagement. When the cam follower operably engages the second cam of the rotating camshaft, preferably a second valve opening distance or range is generated by the operable engagement. The first valve opening distance (range) is preferably different from the second valve opening distance (range). For example, the first valve opening distance (range) may provide, e.g., reciprocal movement of the valve between a valve fully open position and a valve closed position. Further, the second valve opening distance (range) may provide, e.g., reciprocal movement of the valve between a partial or intermediate valve opening position and the valve closed position. The partial or intermediate valve opening position is preferably defined between the valve closed position and the valve fully opened position.

The cam follower may be defined, e.g., on a mounting pin. As indicated above, the cam follower preferably operatively engages the first and second cams in an alternating manner. In other words, the cam follower may have a first mode of operation in which the cam follower operably engages the first cam and a second mode of operation in which the cam follower operably engages the second cam. For example, the cam follower may be arranged and constructed to provide first and second rotational positions relative to the camshaft. In the first rotational position, the cam follower is arranged and constructed to operatively engage the first cam, thereby generating the first valve opening distance (range). In the second rotational position relative to the camshaft, the cam follower is arranged and constructed to operatively engage the second cam, thereby generating the second valve opening distance (range).

A valve lever may rotatably support the mounting pin and/or the cam follower and may be adapted to transmit the respective generated first and second valve opening distances (ranges) to the valve. Further, a locking device may be arranged and constructed to releasably lock the mounting pin and/or the cam follower in the respective first and second rotational positions. Further, when the locking device is not locking or holding the mounting pin and/or the cam follower, the mounting pin and/or the cam follower may be free to rotate, e.g., from the first rotational position to the second rotational position or vice versa. The locking device may lock the mounting pin and/or the cam follower in the first rotational position in the first mode of operation and may lock the mounting pin and/or the cam follower in the second rotational position in the second mode of operation.

The first cam may optionally define a fill valve-lift cam and the second cam may optionally define a partial valve lift cam. The mounting pin may include at least one full valve lift mounting portion and at least one partial valve lift mounting portion. In this case, the full valve lift mounting portion and the partial valve lift portion are preferably arranged eccentrically with respect to a rotational axis of the mounting pin in an angularly displaced relationship. The mounting pin may also include at least one full valve lift cam roller defined or mounted on the at least one full valve lift mounting portion and at least one partial valve lift cam roller defined or mounted on the at least one partial valve lift mounting portion.

In alternative embodiments, the camshaft may optionally be arranged to provide, e.g., (a) two first cams disposed on opposite sides of one second cam or (b) two second cams disposed on opposite sides of one first cam.

A first friction disk optionally may be fixedly attached to the mounting pin. Further, at least a portion of an outer peripheral surface of the first friction disk may be arranged and constructed to frictionally contact a peripheral surface of the camshaft so as to cause the mounting pin to rotate when the first friction disk contacts the camshaft and the mounting pin is not locked by the locking device. The outer peripheral surface of the first friction disk optionally may include at least one flattened portion disposed at a location that will face the camshaft when the mounting pin is disposed in the first rotational position. The first friction disk may be designed in other ways so that the camshaft will not contact the friction disk in the first or second mode of operation. In further preferred embodiments, the locking device may releasably engage and lock the first friction disk in the first rotational position.

In another alternative embodiment, the mounting pin may be rotatably disposed across the valve lever. In such case, the first friction disk may be fixedly attached substantially at a first terminal end of the mounting pin and a second friction disk may be fixedly attached substantially at a second terminal end of the mounting pin.

In another alternative embodiment, the locking device may include a locking pin that is reciprocally, slidably disposed in at least one aperture defined within the valve lever. Optionally, the locking pin may extend substantially parallel to the mounting pin and may be axially displaceable relative to the mounting pin. In a preferred embodiment of the present teachings, a first terminal end of the locking pin may releasably engage and lock the first friction disk in order to prevent rotation of the first friction disk in a first axial position of the locking pin relative to the mounting pin. Further, a second terminal end of the locking pin may releasably engage and lock the second friction disk in order to prevent rotation of the second friction disk in a second axial position of the locking pin relative to the mounting pin.

Optionally, a first recess may be defined within the first friction disk in order to releasably engage the first terminal end of the locking pin. Further, a second recess may be defined within the second friction disk so as to releaseably engage the second terminal end of the locking pin. The first recess may be rotationally displaced relative to the second recess by 180°, although the first and second recesses may optionally be disposed in other arrangements.

In a preferred embodiment, the locking pin may include a piston, a shank extending from the piston and a cover coupled to the shaft. A sleeve may be disposed within the aperture of the valve lever and the locking pin may be slidably disposed within the sleeve. A compression spring may bias the locking pin in a first axial direction. Further, a pressure chamber may be defined within the sleeve. The pressure chamber may be designed such that increased fluid pressure within the pressure chamber urges the locking pin in an second axial direction that is opposite of the first axial direction.

In another alternative embodiment, a first eccentric portion may be defined on the first mounting portion and may be displaced by 180° from a second eccentric portion defined on the second mounting portion with respect to the rotational axis of the mounting pin. In another embodiment, the valve lever may include at least one follower projection defined to provide a third lockable rotational position, in which the cam follower does not operatively engage the first or second cams. The at least one follower projection may press against a raised peripheral surface of the camshaft in the third lockable rotational position, thereby causing the valve lever to maintain the valve in the valve closed position while the camshaft is rotating.

Another alternative apparatus for opening and closing a valve may include rotating means for rotating a cam follower to a first rotational position, at which a first eccentric bearing surface defined on the cam follower operably engages a first cam defined on a rotating camshaft. The first eccentric bearing surface preferably defines a first range of valve opening from a valve closed position generated by the operable engagement of the first eccentric bearing surface and the rotating first cam. The rotating means may also rotate the cam follower to a second rotational position, at which a second eccentric bearing surface defined on the cam follower operably engages a second cam defined on the rotating camshaft. The second eccentric bearing surface preferably defines a second range of valve opening from the valve closed position generated by the operable engagement of the second eccentric bearing surface and the rotating second cam.

Various devices may be employed in the capacity of the rotating means. For example, a device may directly couple, or intermittently couple, the cam follower to the rotating camshaft, or another rotating device within the engine, such that the rotation of the camshaft (or other rotating device) is transmitted to the cam follower. Optionally, a mounting pin may be included within the means for rotating the cam follower, although naturally other arrangements are possible. In addition or in the alternative, a motor may be operably coupled to the cam follower so as to rotate the cam follower in accordance with instructions, e.g., from an engine controller (ECU). Thus, the mounting pin would not be necessary in such an arrangement. The present teachings are not particularly limited in this aspect and, after reading the present teachings, persons of skill in the art will readily recognize various embodiments and devices capable of rotating the cam follower from a first rotational position to a second rotational.

Further, means may be provided for releasably locking the cam follower in (i) the first rotational position and (ii) the second rotational position. In some embodiments, the releasable locking means may define a separate locking device that can be controlled to lock the cam follower in a desired rotational position upon command. Again, various locking devices can be constructed and suitably utilized with the present teachings based upon known lock designs and specific enumeration is not necessary for a skilled-person in the art. In other embodiments, the releasable locking means may be combined with the rotating means, e.g., if the rotating means comprises a stepping motor. Again, various motor designs may be suitably utilized with the present teachings to provide this releasable lock function.

Means also may be provided for transmitting (i) the generated first range of valve opening to the valve, wherein the valve is reciprocally moved between the valve closed position and a valve fully opened position, and (ii) the generated second range of valve opening to the valve, wherein the valve is reciprocally moved between the valve closed position and an intermediate valve open position. The intermediate valve open position may be defined between the valve closed position and the valve fully opened position. Various types of levers may be utilized with this aspect of the present teachings. Further, the transmitting means may preferably rotatably support the cam follower.

In another embodiment of the present teachings, methods for opening and closing a valve are taught. For example, a cam follower may be rotated to a first rotational position, at which a first eccentric bearing surface defined on the cam follower operably engages a first cam defined on a rotating camshaft. As noted above, the first eccentric bearing surface preferably defines a first range of valve opening from a valve closed position generated by the operable engagement of the first eccentric bearing surface and the rotating first cam. The cam follower may then be releasably locked in the first rotational position and the generated first range of valve opening may be transmitted to the valve. As a result, the valve will be reciprocally moved between the valve closed position and a valve fully opened position.

The cam follower may then be rotated to a second rotational position, at which a second eccentric bearing surface defined on the cam follower operably engages a second cam defined on the rotating camshaft. Again, the second eccentric bearing surface preferably defines a second range of valve opening from the valve closed position generated by the operable engagement of the second eccentric bearing surface and the rotating second cam. Then, the cam follower may be releasably locked in the second rotational position, and the generated second range of valve opening may be transmitted to the valve. As a result, the valve will be reciprocally moved between the valve closed position and an intermediate valve open position. Again, the intermediate valve open position is preferably defined between the valve closed position and the valve fully opened position.

Optionally, the cam follower may be rotated to a third rotational position, at which a third eccentric bearing surface defined on the cam follower operably engages a third cam defined on the rotating camshaft. The third eccentric bearing surface preferably defines a third range of valve opening from the valve closed position generated by the operable engagement of the third eccentric bearing surface and the rotating third cam. Then, the cam follower may be releasably locked in the third rotational position, and the generated third range of valve opening may be transmitted to the valve, wherein the valve is reciprocally moved between the valve closed position and a second intermediate valve open position. The second intermediate valve open position may be defined, e.g., between the valve closed position and the intermediate valve open position.

Each of the additional features and teachings disclosed below may be utilized separately or in conjunction with other features and teachings to provide improved lift adjusting devices, camshafts and internal combustion engines and methods for designing and using such devices. Representative examples of the present invention, which examples utilize many of these additional features and teachings both separately and in conjunction, will now be described in further detail with reference to the attached drawings. This detailed description, is merely intended to teach a person of skill in the art further details for practicing preferred aspects of the present teachings and is not intended to limit the scope of the invention. Moreover, combinations of features and steps disclosed in the following detail description may not be necessary to practice the invention in the broadest sense, and are instead taught merely to particularly describe representative examples of the invention. Further, various features of the representative examples and the dependent claims may be combined in ways that are not specifically and explicitly enumerated in order to provide additional useful embodiments of the present teachings. All features disclosed in the description and/or the claims are intended to be disclosed separately and independently from each other for the purpose of original written disclosure, as well as for the purpose of restricting the claimed subject matter independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Figure 2:
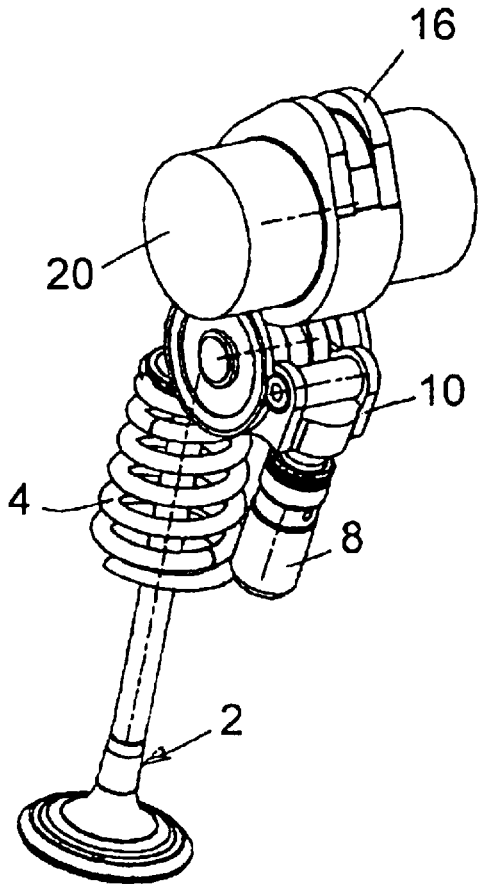
FIG. 2 shows a second perspective view from a different angle of the first representative valve lift adjusting device.

Referring to FIGS. 1 and 2, compression spring 4 normally biases or urges inlet valve 2 towards a valve closed position. Although not shown for the purposes of clarity, inlet valve 2 is preferably reciprocally movable with respect to a valve seat defined in a cylinder head of an internal combustion engine, so as to open and close a valve opening. When valve 2 is disposed in the open position, fuel/air is permitted to be introduced into a cylinder bore defined within the engine or exhaust gas is permitted to be expelled from the cylinder bore after combustion of the fuel. When the valve 2 is disposed in the closed position, the cylinder is substantially sealed. In the following discussion of the preferred embodiments, it is to be understood that valve 2 moves downwardly towards the valve fully opened position and moves upwardly to the valve closed position although valve 2 may be oriented in other ways to open and close the valve opening.

Valve lever 6 may be supported on the cylinder head (not shown) by a play compensating device 8, which urges or biases valve lever 6 into engagement with valve 4 and camshaft 20 during operation. Valve lever 6 preferably includes cam roller 10 that co-operatively follows cam 16 defined on a camshaft 20. Upon rotation of camshaft 20, cam roller 10 supported on valve lever 6 is urged downwardly by cam lobe 16*a*, thereby pivoting valve lever 6 in the counter-clockwise direction as shown in FIGS. 1 and 2. Thus, valve 2 will move towards the valve opening position against the biasing force of compression spring 4. When camshaft 20 further rotates so that cam roller 10 opposes base circle portion 19 of cam 16, compression spring 4 urges valve lever 6 in the clockwise direction. Thus, valve 2 will move towards the valve closing position due to the biasing force of compression spring 4. The arrangement and function of the valve 2, compression spring 4 and the cylinder head are known to persons skilled in the art, e.g. from U.S. Patent Publication No. 2003-24502, and therefore, need not be described in further detail herein.

Figure 3:
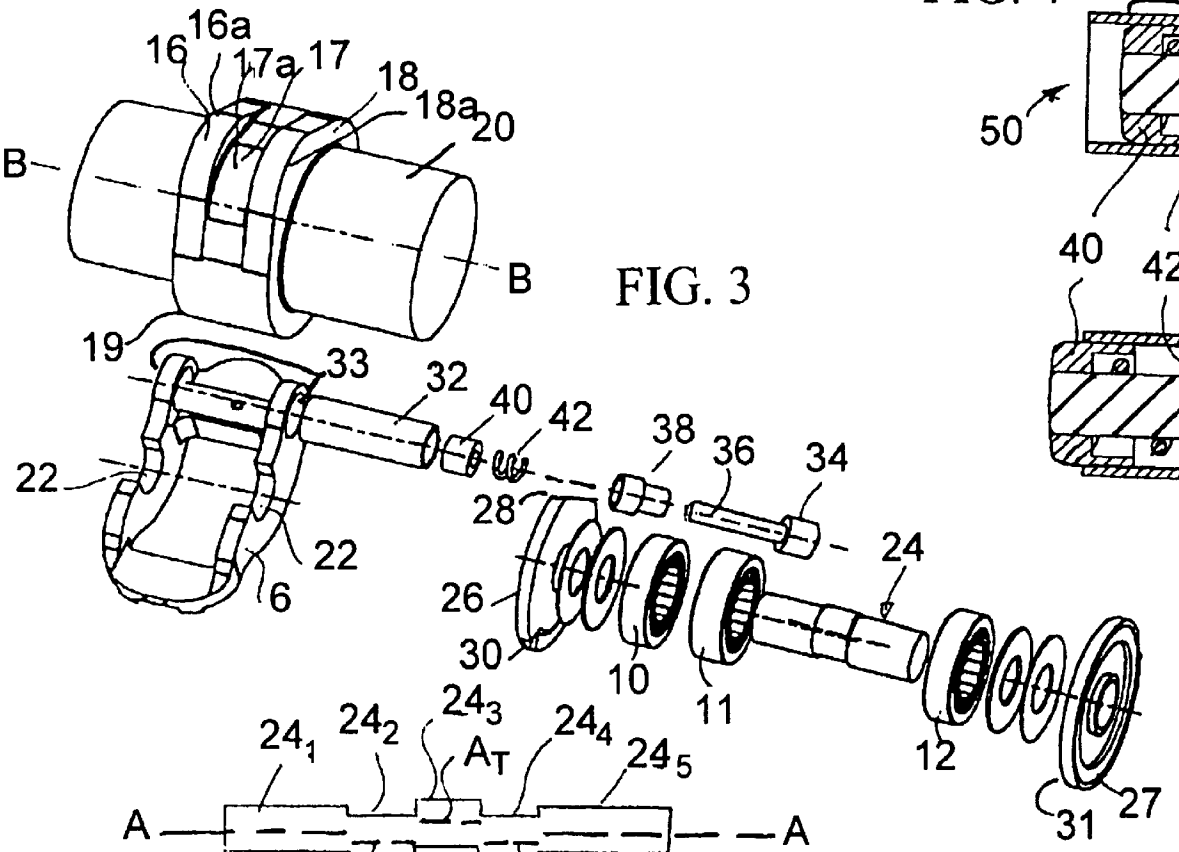
FIG. 3 shows an exploded, perspective view of the first representative valve lift adjusting device.

FIG. 3 shows an expanded view of the first representative embodiment shown in FIGS. 1 and 2, in which camshaft 20 may preferably include three mutually juxtaposed cams 16, 17 and 18. For example, cams 16, 17 and 18 may be disposed within a common base region, but may have different cam lift portions or cam lobes 16 *a*, 17*a*, 18 *a*.

In this representative embodiment, cam 16 may have substantially the same shape and orientation as cam 18, such that cams 16 and 18 have substantially the same design and size. Cams 16, 18 will also be referred to herein as full valve lift cams 16, 18, because cams 16, 18 are capable of causing the greatest degree of movement by valve lever 6, thereby causing valve 2 to open to its widest position. Cam 17 preferably has a smaller shape and size, thereby defining a partial valve lift cam 17. In other words, when partial valve lift cam 17 is operably coupled to valve lever 6, valve 2 will only be partially opened (i.e., less than the above-noted widest open position). Partial valve lift cam 17 may preferably be disposed between full valve lift cams 16 and 18.

Figure 13:
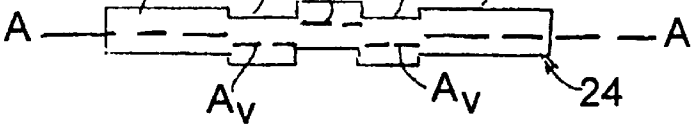
FIG. 13 shows an enlarged view of the representative mounting pin shown in FIG. 3.
Figure 6:
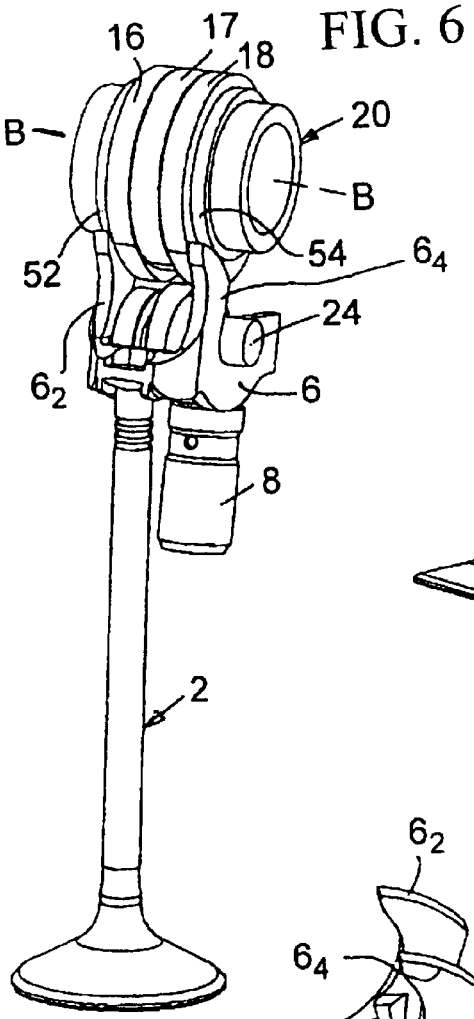
FIG. 6 is a perspective view of a second representative valve lift adjusting device according to the present teachings.
Figure 7:
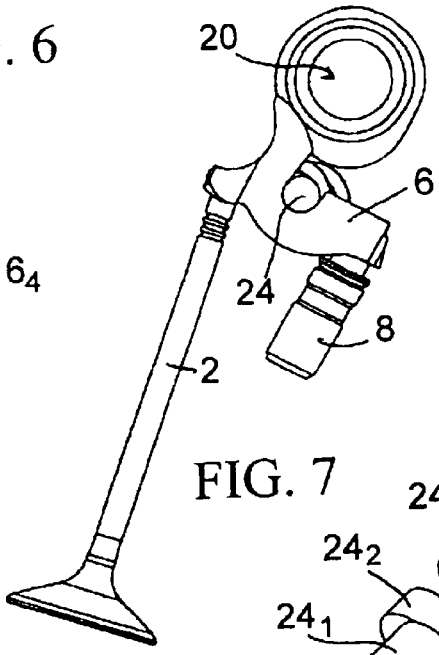
FIG. 7 is an end view of the second representative embodiment shown in FIG. 6.
Figure 8:
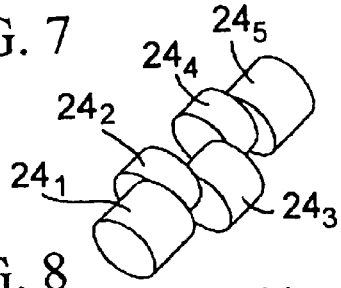
FIG. 8 is a perspective view of a representative mounting pin shown in FIG. 6.
Figure 9:
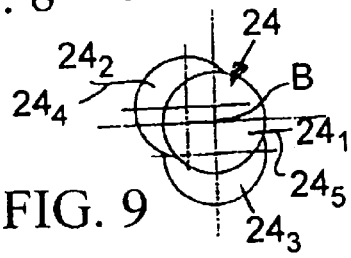
FIG. 9 is a plan view of the representative mounting pin shown in FIG. 8.
Figure 11:
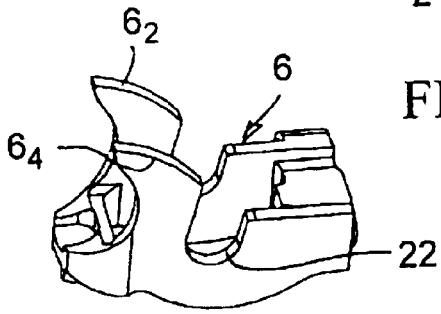
FIG. 11 is a perspective view of the representative valve lever shown in FIG. 6.
Figure 10:
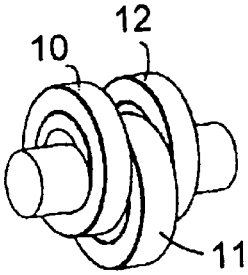
FIG. 10 is a perspective view of the representative mounting pin, which has been fitted with cam rollers.
Figure 12:
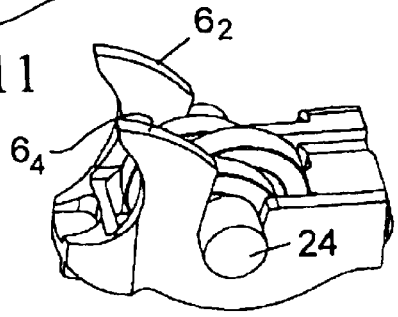
FIG. 12 is a perspective view of the representative valve lever fitted with the representative mounting pin and cam rollers.

Recesses 22 may be defined on or in the valve lever 6 for rotatably supporting a mounting pin 24. FIG. 13 shows an enlarged side view of mounting pin 24, which shows five separate portions $\mathbf{24}_1$, $\mathbf{24}_2$, $\mathbf{24}_3$, $\mathbf{24}_4$ and $\mathbf{24}_5$ that are defined along mounting pin 24. Two outermost portions $\mathbf{24}_1$ and $\mathbf{24}_5$ are preferably aligned along the same axis A. Inner portions $\mathbf{24}_2$ and $\mathbf{24}_4$ are preferably adjacent to (e.g., inwardly adjoin) outermost portions $\mathbf{24}_1$ and $\mathbf{24}_5$. Further, inner portions $\mathbf{24}_2$ and $\mathbf{24}_4$ are preferably aligned along the same axis $A_V$, which is displaced with respect to axis A. Thus, inner portions $\mathbf{24}_2$ and $\mathbf{24}_4$ are preferably arranged eccentrically with respect to outermost portions $\mathbf{24}_1$ and $\mathbf{24}_5$. Finally, central portion $\mathbf{24}_3$ is preferably displaced with respect to axis A in the direction opposite to inner portions $\mathbf{24}_2$ and $\mathbf{24}_4$. Central portion $\mathbf{24}_3$ is preferably aligned with axis $A_T$. The displacement of axis $A_V$ with respect to axis A is preferably equal and opposite to the displacement of axis $A_T$ with respect to axis A.

Cam roller 11 is preferably mounted on (fixedly attached to) central portion $\mathbf{24}_3$. Cam rollers 10, 12 may be respectively mounted on (fixedly attached to) inner portions $\mathbf{24}_2$ and $\mathbf{24}_4$. Outermost portions $\mathbf{24}_1$ and $\mathbf{24}_5$ may be respectively disposed (or rotatably mounted) within recesses 22. Friction disks 26, 27 may be disposed at the respective outer ends of each of outermost portions $\mathbf{24}_1$ and $\mathbf{24}_5$. Further, friction disks 26, 27 are preferably non-rotatably (e.g., fixedly) connected to the mounting pin 24. Spacer disks (shown but not numbered) optionally may be disposed around the mounting pin 24 between cam rollers 10, 11, 12 and friction disks 26, 27.

The particular arrangement of mounting portions $\mathbf{24}_1$, $\mathbf{24}_2$, $\mathbf{24}_3$, $\mathbf{24}_4$ and $\mathbf{24}_5$ and cam rollers 10, 11, 12 described in the preferred embodiments is not particularly limited according to the present teachings, and a skilled person will understand that these elements may be disposed in various other arrangements in order to achieve the same result. Further, cam rollers 10, 11, 12 and mounting pin 24 may be, e.g., integrally formed as a single integral element, if desired. It is only significant that the outer contour of cam rollers 10, 11, 12 is provided according to the present teachings. Various designs for achieving such an outer contour will be readily understandable to persons skilled in the art and need not be explicitly described herein. In addition or in the alternative, friction disks 26, 27 may be integrally incorporated with mounting pin 24.

In the assembled condition, outermost portions 24, and 245 are accommodated in recesses 22 formed in the respective side walls of valve lever 6. Thus, cam rollers 10, 11 and 12 will be disposed between the side walls of valve lever 6. In addition, friction disks 26 and 27 are preferably disposed outside (i.e., on the opposite side of) the respective side walls of valve lever 6. In this particular representative embodiment, cam roller 11 is arranged and constructed so as to correspond to, and operably engage, partial valve lift cam 17, thereby defining a partial valve lift cam roller. Thus, central portion $\mathbf{24}_3$ defines a partial valve lift mounting portion for supporting cam roller 11. As noted above, however, other arrangements are possible and moreover, two or more partial lift cam rollers may be defined according to the present teachings.

Cam rollers 10, 12 are preferably disposed so as to correspond to, and operably engage, full valve lift cams 16 and 18, thereby defining full valve lift cam rollers. Thus, inner portions $\mathbf{24}_2$ and $\mathbf{24}_4$ define full valve lift mounting (inner) portions of mounting pin 24.

The diameters and degrees of eccentricity of cam rollers 10, 11, 12 may preferably be selected according to the following considerations. But first, for purposes of discussion, it is noted that the cross-section of representative camshaft 20 shown in FIG. 3 includes base circle portion 19 and cam lobes 16*a*, 17*a*, 18*a*. Base circle portion 19 comprises the portion of cams 16, 17, 18 having the smallest radius from rotational axis B. Cam lobe portion 16*a* comprises the portion of cam 16 that extends or projects with respect to base circle portion 19 and includes a portion having the largest radius from rotational axis B.

Thus, when mounting pin 24 is rotated to and held in the position where full valve lift mounting portions $\mathbf{24}_2$ and $\mathbf{24}_4$ are positioned closest to rotational axis B—B of camshaft 20, the protruding portions of full valve lift cam rollers 10 and 12 will operably engage camshaft 20. As camshaft 20 rotates, base circle portion 19 will press against lift cam rollers 10, 12. In this camshaft rotational position, valve 2 will be disposed in the valve closed position (i.e., zero valve opening distance). Then, when camshaft 20 rotates such that cam lobes 16*a*, 18*a* operatively engage cam rollers 10, 12, valve 2 will be disposed in the valve fully opened position (i.e., full valve opening distance).

When mounting pin 24 is rotated by 180° from the above-noted rotational position, the protruding portions of cam rollers 10, 12 will effectively move away from rotational axis B and the protruding portion of cam roller 11 will move closer to rotational axis B. Therefore, in this state, cam roller 11 will operably engage cam lobe 17*a* of camshaft 20. As noted above, cam roller 11 defines a part-lift cam roller and central portion $\mathbf{24}_3$ forms a part-lift mounting portion. Therefore, when base circle portion 19 presses against cam roller 11, valve 2 will be disposed in the valve closed position. When camshaft 20 rotates and cam lobe 17*a* presses against cam roller 11, valve 2 will be disposed in the valve partially-opened position (i.e., partial valve opening distance). Thus, when mounting pin 24 is held in this rotational position, valve 2 will be restricted to reciprocally moving between the valve closed position and the valve partially opened position. As noted above, the partial or intermediate valve opening position provides a smaller valve opening distance than the full valve opening position.

The diameter of friction disks 26, 27 is preferably selected such that friction disks 26, 27 press against and engage the peripheral surface of the camshaft 20 on opposite sides of cams 16, 17, 18. Therefore, when neither friction disk 26, 27 is locked, camshaft 20 will cause mounting pin 24 to freely rotate about rotational axis A.

Recess 30 is preferably defined within the inner surface of friction disk 26. Similarly, recess 31 is preferably defined within the inner surface of friction disk 27. For purposes of clarity, only recess 30 is explicitly shown in FIG. 3, but reference number 31 has been included to indicate the intended position of recess 31 on the inwardly facing surface of friction disk 27. In the assembled condition, recesses 30, 31 are preferably displaced by 180° about rotational axis A. As discussed further below, this rotational displacement of recesses 30, 31 enables mounting pin 24 to be releasably locked in first and second (different) rotational positions that are separated by 180° about rotational axis A. When mounting pin 24 is held or locked in the first rotational position, full valve lift cams 16, 18 will operably engage cam rollers 10, 12. When mounting pin 24 is held or locked in the second rotational position, part-lift cam 17 will operably engage cam roller 11 and full-lift cams 16, 18 will not engage or contact cam rollers 10, 12.

Locking device 50 may be utilized to alternatively engage recess 30 or recess 31, thereby locking mounting pin 24 in either the first rotational position or the second rotational position. As noted above, a wide variety of equivalent locking devices may be utilized to perform this releasable locking function of the present teachings, and the present teachings are not particularly limited in this regard. However, for purposes of further explaining the function of a representative locking device, representative locking device 50 will be described in further detail with reference to FIGS. 4 and 5.

For example, locking device 50 may include sleeve 32 that is fitted into mutually opposing apertures 33 defined within valve lever 6. Sleeve 32 may be, e.g., cylinder shaped (although other shapes are contemplated) and piston 34 may be slidably disposed within sleeve 32. Shank 36 may extend from piston 34 and may be guided by bush 38, which is preferably non-displaceably mounted (e.g., frictional fitted) within sleeve 32. Cover 40 may be affixed to the free (terminal) end of shank 36 and may slidably contact sleeve 32. The combination of piston 34, shank 36 and cover 40 will be generically referred to as locking pin 41.

Figure 4:
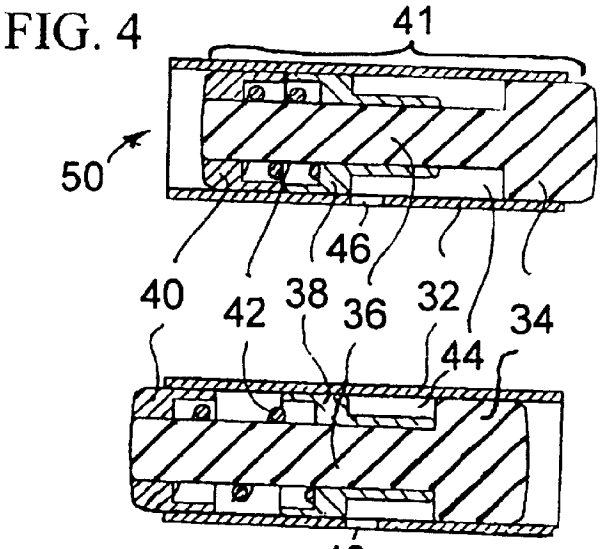
FIG. 4 shows a cross-sectional view through a representative locking device in a first state.
Figure 5:
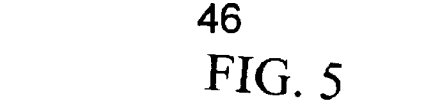
FIG. 5 shows a cross-sectional view through the representative locking device of FIG. 4 in a second state.

Compression spring 42 is preferably disposed between cover 40 and bush 38, so as to bias or urge locking pin 41 towards the left as shown in FIGS. 4 and 5. In addition, pressure chamber 44 may be defined within the space enclosed by sleeve 32, piston 34, shank 36 and bush 38. Fluid (not shown) may enter and exit pressure chamber 44 via opening 46, so as to provide a source of pressure within the pressure chamber 44. When pressurized fluid is introduced into pressure chamber 44, locking pin 41 will be urged towards the right, as shown in FIG. 4, against the biasing force of compression spring 42. Thus, when pressurized fluid is introduced into pressure chamber 44, piston 34 will protrude from the right side of sleeve 32, as shown in FIG. 4. On the other hand, when pressure chamber 44 is not under pressure (i.e., fluid is permitted to exit pressure chamber 44), compression spring 42 will urge locking pin 41 towards the left most position and cover 40 will protrude from the left side of sleeve 32, as shown in FIG. 5.

Locking device 50 may be fitted within the valve lever 6, e.g., so that (i) cover 40 will engage recess 30 of friction disk 26 when cover 40 projects from sleeve 32, (the state shown in FIG. 5) and (ii) piston 34 will engage recess 31 of friction disk 27 when piston 34 projects from sleeve 32 (the state shown in FIG. 4). When cover 40 projects into and engages recess 30, friction disk 26 is prevented from rotating, even though the outer peripheral surface of friction disk 26 may be in contact with rotating camshaft 20. Thus, in this state, friction disk 26 will be locked in position, thereby holding or locking mounting pin 24 in the first rotational position. When piston 34 projects into and engages recess 31, friction disk 27 is prevented from rotating, again even though the outer peripheral surface of friction disk 27 may be in contact with rotating camshaft 20. Thus, in this state, friction disk 27 will be locked in position, thereby holding mounting pin 24 in the second rotational position. When neither cover 40 or piston 34 protrudes from sleeve 32, friction disks 26, 27 and mounting pin 24 are free to rotate about rotational axis A.

As noted above, recesses 30, 31 are respectively defined within friction disks 26, 27 so as to enable mounting pin 24 to be releasably locked in the first and second rotational positions, which are opposite of each other (displaced by 180°) in this first representative embodiment. For example, friction disk 26 may be locked or prevented from rotating in the first rotational position, thereby disposing mounting pin 24 in a full valve lift locking position. Thus, in the first rotational position, full valve lift cams 16 and 18 will operable engage cam rollers 10, 12, as discussed above. On the other hand, when friction disk 27 is locked or prevented from rotating in the second rotational position, mounting pin 24 will be disposed in a partial valve lift locking position. Thus, in the second rotational position, part-lift cam 17 will operably engage cam roller 11, as discussed above.

A representative method for operating the first representative embodiment will now be described in further detail. Initially, locking device 50 may be disposed in the configuration or state shown in FIG. 5, in which rotational movement of friction disk 26 is prevented, because cover 40 projects from sleeve 32 into recess 30 of friction disk 26. As a result, mounting pin 24 will be locked in the first rotational position and cam rollers 10, 12 will operably engage full valve lift cams 16, 18 as camshaft 20 rotates. Accordingly, inlet valve 2 will reciprocally move between the valve closed position and the valve fully opened position as camshaft 20 rotates. The biasing force of compression spring 42 will maintain the projection of cover 40 into recess 30, thereby locking mounting pin 24 in the first rotational position. This full valve lift position may be utilized, e.g., when the engine is operated so as to provide a relatively high power output in order to permit the fuel/air mixture to enter the cylinder bore without restriction due to valve opening distance in the valve fully opened position.

When it is desired to switch to partial valve lift, e.g., because the engine power output is reduced, pressurized fluid may be forced into pressure chamber 44, thereby causing cover 40 to withdraw from recess 30 of friction disk 26. As a result, friction disk 26 is permitted to freely rotate. Because the outer peripheral surfaces of friction disks 26, 27 frictionally contact the external contour (peripheral surface) of camshaft 20, friction disks 26, 27 will rotate, thereby causing mounting pin 24 to also rotate. However, when piston 34, which displaced to the rightmost position by pressure actuation of pressure chamber 44 (FIG. 4), protrudes from sleeve 32 into recess 31 of friction disk 27, further rotational movement of friction disk 27 will be prevented, thereby locking mounting pin 24 in the second rotational position. Consequently, cam roller 11 will operably engage partial valve lift cam 17 and valve 2 will reciprocally move between the valve closed position and the valve partially opened position (intermediate valve opening distance). In other words, the valve partially opened position is an intermediate position between the valve closed position and the valve fully opened position. Thus, the reduced valve opening distance can be advantageously utilized to (i) directly throttle the fuel/air flow into the cylinder bore and/or (ii) increase the velocity of the fuel/air flow into the cylinder bore, thereby improving the mixing of the fuel and air before combustion.

As shown in FIG. 3, the peripheral surfaces of friction disks 26 and 27 optionally may include a flattened portion 28 that faces the camshaft 20 when the particular friction disk 26, 27 is locked in position. In this case, little or no frictional engagement occurs between friction disk 26, 27 and camshaft 20 when mounting pin 24 is disposed in a locked rotational position. If friction disks 26, 27 (and thus mounting pin 24) are permitted to rotate before valve 2 is fully closed, mounting pin 24 will be caused to rotate by whichever cam roller(s) 10, 11, 12 is (are) still being subjected to a force from the corresponding cam due to the eccentricity of the respective mounting axis. Therefore, friction disks 26, 27 will rotate in a corresponding manner and come into frictional contact with camshaft 20. As a result, complete switching-over (i.e., mounting pin 24 rotation) is enabled, at least to a substantial degree, while base circle portion 19 of the respective cams is pressing the corresponding cam roller(s).

In a modification of this design, one or both friction disk 26, 27 may include a ramp defined on the inner surfaces of friction disk 26, 27. The ramps may be directed respectively towards piston 34 and cover 40 at locations that are displaced by 180° with respect to recess 30. Therefore, when one friction disk is released, the piston or the cover respectively moves against the ramp defined on the other friction disk. Each ramp preferably may include an inclined surface so that rotation of the friction disk is prevented by the contact, respectively, of the piston or the cover. When rotation of mounting pin 24 should be permitted or enabled, friction disk 26, 27 may be moved so as to press against camshaft 20 in order to be rotated thereby.

FIGS. 6–12 show a second representative embodiment of another valve lift adjusting device according to the present teachings, wherein like elements have been assigned the same reference numerals that were utilized in FIGS. 1–5. One notable difference from the first representative embodiment concerns valve lever 6, which may preferably include follower projections $\mathbf{6}_2$, $\mathbf{6}_4$ defined thereon. Further, in this second representative embodiment, mounting pin 24 may be releasably locked in first, second and third rotational positions.

When none of cam rollers 10, 11, 12 is operably engaged with cams 16, 17, 18, follower projections 62, 64 preferably press against raised peripheral surfaces 52, 54 of camshaft

20, thereby holding valve 2 in the valve closed position. Friction disks 26, 27 (FIG. 3) are not shown in FIGS. 6–12 for purposes of clarity, but also may be utilized in the second representative embodiment in order to hold or lock mounting pin 24 in the three different (locked) rotational positions (e.g., a full valve lift position, a partial or intermediate valve lift position and a zero valve lift position). Full valve lift mounting portions $\mathbf{24}_2$, $\mathbf{24}_4$ are preferably displaced by 120° (and 240° respectively) with respect to partial-lift mounting portion $\mathbf{24}_3$ of mounting pin 24, as is particularly shown in FIG. 9. Therefore, the first locking position of the mounting pin 24 corresponds to the position at which full valve lift cam rollers 10, 12, which are disposed on full valve lift mounting portions $\mathbf{24}_2$, $\mathbf{24}_4$, are operative. The second locking position of mounting pin 24 is displaced by 120° from the first locking position and, in the second locking position, partial valve lift cam roller 11 mounted on the partial-lift mounting portion $\mathbf{24}_3$ is operative. In the third locking position (displaced by 120° from the second locking position), cam rollers 10, 11, 12 are disposed in an inoperative position and follower projections $\mathbf{6}_2$, $\mathbf{6}_4$ press against raised peripheral surfaces 52, 54 of the camshaft 20. In this case, when valve 2 is closed, valve lever 6 is held in a play-free condition so as to press against camshaft 20 due to the biasing force supplied by play-compensating element 8.

It will be appreciated that the locking device 50 (FIG. 4) should be modified so that friction disks 26, 27 can be held and locked in three different rotational positions. This modification can be effected, for example, by providing three recesses (each displaced by 120°) on the inwardly facing surface of only one of the disks. Further, a pushrod can be moved hydraulically or magnetically into and out of the sleeve 32 so as to be brought into engagement with the respective recesses. A unique aspect of such a structure is that the three locking positions can be successively approached one after the other. Another possible way of locking the friction disks involves providing three different pins that are actuated hydraulically or magnetically and engage three different recesses. For example, two recesses may be defined on one friction disk at different radii and the third recess may be defined on the other friction disk.

Both the first and second representative embodiments can be advantageously fitted onto known cylinder heads, and it is only necessary to replace the camshaft and the valve levers. Thus, comprehensive engine redesign is not required in order to utilize the present teachings.

Various modifications of the first and second representative embodiments will be readily appreciated by a person of skill in the art. For example, as indicated above, two or more eccentric contact surfaces may be integrally defined on the mounting pin, thereby eliminating the necessity of utilizing separately manufactured cam rollers. In another modification, additional cam rollers may be mounted on the follower projections of the mounting lever. Further, more than three locking positions may be provided with corresponding cam followers, thereby affording greater degrees of freedom in terms of the valve opening variation.

Moreover, the entire arrangement is not required to be symmetrical in order to prevent mounting pin 24 from tilting during operation. In the above described arrangements, duplicated cams 16, 18 were provided and will ordinarily prevent tilting of mounting pin 24 during operation. However, only one full lift cam 16, 18 may be utilized with the present teachings. In this case, valve lever 6 may be, e.g., supported on a shaft in order prevent tilting.

Devices for rotating mounting pin 24 between its various locking positions and the locking device can be suitably modified with or replaced by widely varying design configurations. For example, a hydraulic or electric stepping motor may be utilized to rotate and lock mounting pin 24 in the various rotational position. In such an embodiment, the friction disks may be omitted.

Furthermore, the shape and sizes of cam rollers 10, 11, 12 and cams 16, 17, 18 may be suitably changed in order to change, e.g., the amount of valve lift, the duration of the valve opening, the valve opening profile (e.g., faster opening and slower closing of the valve), symmetrical cam lobes to asymmetrical cam lobes, etc.

Moreover, additional teachings relevant to, and combinable with, the present teachings can be found in U.S. Pat. Nos. 5,431,132, 5,586,527, 5,558,411, 5,592,906, 5,758,615, 5,797,368, 5,908,015, 5,960,750, 6,009,861, 6,067,948, 6,131,545, 6,186,101, 6,202,607, 6,273,116, 6,442,184 and 6,581,552 and U.S. Patent Publication No. 2003-24502, all of which are incorporated herein by reference as if fully set forth herein.

For ease of reference when viewing the accompanying drawings, the following list of elements is provided with their respective reference numerals:

2 inlet valve
4 compression (valve closing) spring
6 valve lever
$\mathbf{6}_2$, $\mathbf{6}_4$ camshaft follower projection
8 play-compensating device
10, 11, 12 cam rollers
16, 17, 18 cams
16*a*, 17*a*, 18*a* cam lobes
19 base circle portion of cams 16, 17, 18
20 camshaft
22 recesses
24 mounting pin
$\mathbf{24}_1$, $\mathbf{24}_2$, $\mathbf{24}_3$, $\mathbf{24}_4$, $\mathbf{24}_5$ cam roller mounting portions
26, 26 friction disk
28 flattened portion
30, 31 recesses
32 sleeve
33 aperture in valve lever 6
34 piston
36 shank
38 bush
40 cover
41 locking pin
42 compression spring
44 pressure chamber
46 opening in locking device 50
50 locking device
52, 54 raised peripheral surfaces of camshaft 20

What is claimed is:

1. An apparatus suitable for use in reciprocally moving a valve, comprising:

a camshaft comprising at least a first cam having a first cam lobe defining a first amount of valve opening and a second cam having a second cam lobe defining a second amount of valve opening, the first amount of valve opening being different from the second amount of valve opening, a valve lever, a mounting pin rotatable supported by the valve lever, a cam follower defined on the mounting pin and being arranged and constructed to provide;

a first rotational position relative to the valve lever at which the cam follower is arranged and constructed to operatively engage the first cam and to not engage the second cam, whereby the first amount of valve opening is generated, and a second rotational position relative to the valve lever at which the cam follower is arranged and constructed to operatively engage the second cam and to not engage the first cam, whereby the second amount of valve opening is generated, a wherein the valve lever is adapted to transmit the respective generated first and second amounts of valve opening to the valve, and a locking device arranged and constructed to releasably lock the cam follower in the respective first and second rotational positions and being further arranged and constructed to permit rotation of the cam follower when the mounting pin is not locked.

2. An apparatus as in claim 1, wherein the first cam defines a full valve-lift cam and the second cam defines a partial valve lift cam, the mounting pin includes at least one full valve lift mounting portion and at least one partial valve lift mounting portion, the full valve lift mounting portion and the partial valve lift portion being arranged eccentrically with respect to a rotational axis of the mounting pin in an angularly displaced relationship, and the mounting pin further comprising at least one full valve lift cam roller mounted on the at least one full valve lift mounting portion and at least one partial valve lift cam roller mounted on the at least one partial valve lift mounting portion.

3. An apparatus as in claim 2, wherein the camshaft comprises an arrangement selected from the group consisting of (a) two first cams disposed on opposite sides of one second cam and (b) two second cams disposed on opposite sides of one first cam.

4. An apparatus as in claim 3, further comprising a first friction disk non-rotatably attached to the mounting pin, wherein at least a portion of an outer peripheral surface of the first friction disk is arranged and constructed to frictionally contact a peripheral surface of the camshaft so as to cause the mounting pin to rotate when the first friction disk contacts the camshaft and the mounting pin is not locked by the locking device.

5. An apparatus as in claim 4, wherein the outer peripheral surface of the first friction disk comprises at least one flattened portion disposed at a location that will face the camshaft when the mounting pin is disposed in the first rotational position.

6. An apparatus as in claim 5, wherein the locking device is arranged and constructed to releasably engage and lock the first friction disk in the first rotational position.

7. An apparatus as in claim 6, wherein the mounting pin is rotatably disposed across the valve lever, the first friction disk is fixedly attached substantially at a first terminal end of the mounting pin and a second friction disk is fixedly attached substantially at a second terminal end of the mounting pin.

8. An apparatus as in claim 7, wherein the locking device comprises a locking pin reciprocally, slidably disposed in at least one aperture defined within the valve lever, the locking pin extending substantially parallel to the mounting pin and being axially displaceable relative to the mounting pin, wherein a first terminal end of the locking pin is arranged and constructed to releasably engage and lock the first friction disk, thereby preventing rotation of the first friction disk in a first axial position of the locking pin relative to the mounting pin, and a second terminal end of the locking pin is arranged and constructed to releasably engage and lock the second friction disk, thereby preventing rotation of the second friction disk in a second axial position of the locking pin relative to the mounting pin.

9. An apparatus as in claim 8, wherein a first recess is defined within the first friction disk, the first recess being arranged and constructed to releasably engage the first terminal end of the locking pin, and a second recess is defined within the second friction disk, the second recess being arranged and constructed to releaseably engage the second terminal end of the locking pin, and wherein the first recess is rotationally displaced relative to the second recess by 180°.

10. An apparatus as in claim 9, wherein the locking pin comprises a piston, a shank extending from the piston and a cover coupled to the shaft, further comprising:

a sleeve disposed within the aperture of the valve lever, the locking pin being slidably disposed within the sleeve, a compression spring biasing the locking pin in a first axial direction and a pressure chamber defined within the sleeve, the pressure chamber being arranged and constructed such that increased fluid pressure within the pressure chamber urges the locking pin in a second axial direction that is opposite of the first axial direction.

11. An apparatus as in claim 10, wherein a first eccentric portion defined on a first mounting portion of the mounting pin is displaced by 180° from a second eccentric portion defined on a second mounting portion of the mounting pin with respect to a rotational axis of the mounting pin.

12. An apparatus as in claim 11, wherein the valve lever comprises at least one follower projection defined to provide a third lockable rotational position, at which the cam follower does not operatively engage the first or second cams, the at least one follower projection being arranged and constructed to press against a raised peripheral surface of the camshaft in the third lockable rotational position, thereby causing the valve lever to maintain the valve in the valve closed position while the camshaft is rotating.

13. An apparatus as in claim 1, wherein the camshaft comprises an arrangement selected from the group consisting of (a) two first cams disposed on opposite sides of one second cam and (b) two second cams disposed on opposite sides of one first cam.

14. An apparatus as in claim 1, further comprising a first friction disk non-rotatably attached to the mounting pin, wherein at least a portion of an outer peripheral surface of the first friction disk is arranged and constructed to frictionally contact a peripheral surface of the camshaft so as to cause the mounting pin to rotate when the first friction disk contacts the camshaft and the mounting pin is not locked by the locking device.

15. An apparatus as in claim 14, wherein the outer peripheral surface of the first friction disk comprises at least one flattened portion disposed at a location that will face the camshaft when the mounting pin is disposed in the first rotational position.

16. An apparatus as in claim 15, wherein the locking device is arranged and constructed to releasably engage and lock the first friction disk in the first rotational position.

17. An apparatus as in claim 16, wherein the mounting pin is rotatably disposed across the valve lever, the first friction disk is fixedly attached substantially at a first terminal end of the mounting pin and a second friction disk is fixedly attached substantially at a second terminal end of the mounting pin.

18. An apparatus as in claim 1, wherein the locking device comprises a locking pin reciprocally, slidably disposed in at least one aperture defined within the valve lever, the locking pin extending substantially parallel to the mounting pin and being axially displaceable relative to the mounting pin, wherein a first terminal end of the locking pin is arranged and constructed to releasably engage and lock a first friction disk disposed on the mounting pin, thereby preventing rotation of the first friction disk in a first axial position of the locking pin relative to the mounting pin, and a second terminal end of the locking pin is arranged and constructed to releasably engage and lock a second friction disk disposed on the mounting pin, thereby preventing rotation of the second friction disk in a second axial position of the locking pin relative to the mounting pin.

19. An apparatus as in claim 18, wherein a first recess is defined within the first friction disk, the first recess being arranged and constructed to releasably engage the first terminal end of the locking pin, and a second recess is defined within the second friction disk, the second recess being arranged and constructed to releaseably engage the second terminal end of the locking pin, and wherein the first recess is rotationally displaced relative to the second recess by 180°.

20. An apparatus as in claim 18, wherein the locking pin comprises a piston, a shank extending from the piston and a cover coupled to the shaft, further comprising:

a sleeve disposed within the aperture of the valve lever, the locking pin being slidably disposed within the sleeve, a compression spring biasing the locking pin in a first axial direction and a pressure chamber defined within the sleeve, the pressure chamber being arranged and constructed such that increased fluid pressure within the pressure chamber urges the locking pin in a second axial direction that is opposite of the first axial direction.

21. An apparatus as in claim 1, wherein a first eccentric portion defined on a first mounting portion of the mounting pin is displaced by 180° from a second eccentric portion defined on a second mounting portion of the mounting pin with respect to a rotational axis of the mounting pin.

22. An apparatus as in claim 1, wherein the valve lever comprises at least one follower projection defined to provide a third lockable rotational position, at which the cam follower does not operatively engage the first or second cams, the at least one follower projection being arranged and constructed to press against a raised peripheral surface of the camshaft in the third lockable rotational position, thereby causing the valve lever to maintain the valve in the valve closed position while the camshaft is rotating.

23. An apparatus for opening and closing a valve, comprising:

rotating means (i) for rotating a cam follower to a first rotational position, at which a first bearing surface defined on the cam follower operably engages a first cam defined on a rotating camshaft, wherein the operable engagement of the first bearing surface and the rotating first cam defines a first range of valve opening distance from a valve closed position, and (ii) for rotating the cam follower to a second rotational position, at which a second bearing surface defined on the cam follower operably engages a second cam defined on the rotating camshaft, wherein the operable engagement of the second bearing surface and the rotating second cam defines a second range of valve opening distance from the valve closed position, means for releasably locking the cam follower in (i) the first rotational position and (ii) the second rotational position, and means for transmitting (i) the first range of valve opening distance to the valve, such that the valve is reciprocally moved between the valve closed position and a valve fully opened position, and (ii) the second range of valve opening distance to the valve, such that the valve is reciprocally moved between the valve closed position and an intermediate valve open position, the intermediate valve open position being defined between the valve closed position and the valve fully opened position.

24. A method for opening and closing a valve, comprising:

rotating a cam follower to a first rotational position, at which a first bearing surface defined on the cam follower operably engages a first cam defined on a rotating camshaft, wherein the operable engagement of the first bearing surface and the rotating first cam defines a first range of valve opening distance from a valve closed position, releasably locking the cam follower in the first rotational position, transmitting the first range of valve opening distance to the valve, thereby reciprocally moving the valve between the valve closed position and a valve fully opened position, rotating the cam follower to a second rotational position, at which a second bearing surface defined on the cam follower operably engages a second cam defined on the rotating camshaft, wherein the operable engagement of the second bearing surface and the rotating second cam defines a second range of valve opening distance from the valve closed position, releasably locking the cam follower in the second rotational position, and transmitting the second range of valve opening distance to the valve, thereby reciprocally moving the valve between the valve closed position and an intermediate valve open position, the intermediate valve open position being defined between the valve closed position and the valve fully opened position.

25. A method as in claim 24, further comprising:

rotating the cam follower to a third rotational position, at which a third bearing surface defined on the cam follower operably engages a third cam defined on the rotating camshaft, wherein the operable engagement of the third bearing surface and the rotating third cam defines a third range of valve opening distance from the valve closed position, releasably locking the cam follower in the third rotational position, and transmitting the third range of valve opening distance to the valve, thereby reciprocally moving the valve between the valve closed position and a second intermediate valve open position, the second intermediate valve open position being defined between the valve closed position and the intermediate valve open position.

* * * * *

UNITED STATES PATENT AND TRADEMARK OFFICE

CERTIFICATE OF CORRECTION

PATENT NO. : 6,848,402 B2
DATED : February 1, 2005
INVENTOR(S) : Kreuter

It is certified that error appears in the above-identified patent and that said Letters Patent is hereby corrected as shown below:

Column 14, lines 52-67 thru Column 15, lines 1-15,
Claim 1 should read as follows:
What is claimed is:
1. An apparatus suitable for use in reciprocally moving a valve, comprising:
a camshaft comprising at least a first cam having a first cam lobe defining a first amount of valve opening
and a second cam having a second cam lobe defining a second amount of valve opening, the first amount of valve opening being different from the second amount of valve opening,
a valve lever,
a mounting pin rotatably supported by the valve lever,
a cam follower defined on the mounting pin and being arranged and constructed to provide:
a first rotational position relative to the valve lever at which the cam follower is arranged and constructed
to operatively engage the first cam and to not engage the second cam, whereby the first amount of valve opening is generated, and
a second rotational position relative to the valve lever at which the cam follower is arranged and constructed to operatively engage the second cam and to not engage
the first cam, whereby the second amount of valve opening is generated,
wherein the valve lever Is adapted to transmit the respective generated first and second amounts of valve opening to the valve, and
a locking device arranged and constructed to releasably lock the cam follower in the respective first and second rotational positions and being further arranged and constructed to permit rotation of the cam follower when the mounting pin is not locked.

Signed and Sealed this

Twenty-sixth Day of July, 2005

JON W. DUDAS
*Director of the United States Patent and Trademark Office*